US008267703B2

(12) United States Patent
Yao et al.

(10) Patent No.: US 8,267,703 B2
(45) Date of Patent: Sep. 18, 2012

(54) CONNECTOR HAVING METAL SHELL SHIELDING INSULATIVE HOUSING

(75) Inventors: Zhong-Hua Yao, Kunshan (CN); Qi-Sheng Zheng, Kunshan (CN); Hong-Bin Gong, Kunshan (CN); Jia-Yong He, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/088,438

(22) Filed: Apr. 18, 2011

(65) Prior Publication Data

US 2012/0009818 A1 Jan. 12, 2012

(30) Foreign Application Priority Data

Jul. 8, 2010 (CN) ..... 2010 2 0251868

(51) Int. Cl.
*H01R 12/00* (2006.01)

(52) U.S. Cl. ..... 439/79; 439/607.36

(58) Field of Classification Search ..... 439/79, 439/607.01, 607.35–607.4, 607.54, 626, 439/660

See application file for complete search history.

(56) References Cited

U.S. PATENT DOCUMENTS

| | | | | |
|---|---|---|---|---|
| 7,422,488 | B1 | 9/2008 | Wu | |
| 7,618,293 | B2 | 11/2009 | Wu | |
| 7,744,426 | B2 * | 6/2010 | Zheng et al. | 439/660 |
| 8,007,323 | B1 * | 8/2011 | Yao et al. | 439/660 |
| 8,062,050 | B2 * | 11/2011 | Wu | 439/350 |

FOREIGN PATENT DOCUMENTS

| | | |
|---|---|---|
| TW | M377765 | 4/2010 |

* cited by examiner

*Primary Examiner* — Khiem Nguyen

(74) *Attorney, Agent, or Firm* — Wei Te Chung; Andrew C. Cheng; Ming Chieh Chang

(57) ABSTRACT

A connector (100) includes an insulative housing (1), a set of contacts (3) attached to the insulative housing, an insulator (2) retained in the insulative housing (1) and a metal shell (4) covering the insulative housing and the insulator. The insulative housing has a base portion (11) and a tongue potion (12) extending from the base portion (11). The base portion has a retaining slot (1110) and a pair of side walls (113), each side wall has a protrusion (1131) protruding outwardly from an outer face thereof. The insulator (2) is retained in the retaining slot and has a pair of side surfaces (23) facing inner faces of the side wall. At least one clearance is formed between the adjacent side surface and inner face and is corresponding to the protrusions (1131, 1132) respectively in a transverse direction. The metal shell (4) includes a top plate (41), a bottom plate (42), and a pair of side plates (43) passing over the protrusions in a front-to-back direction when the metal shell (4) is assembled to the insulative housing (1).

20 Claims, 7 Drawing Sheets

CONNECTOR HAVING METAL SHELL SHIELDING INSULATIVE HOUSING

BACKGROUND OF THE INVENTION

1. Field of the Invention

The present invention relates to a connector, and more particularly to a connector having a metal shell shielding an insulative housing.

2. Description of Related Art

At present, Universal Serial BUS (USB) is a widely used as an input/output interface adapted for many electronic devices, such as personal computer and related peripherals. A conventional USB plug connector usually comprises an insulative housing defining a base portion and a tongue portion extending forwardly from the base portion; a plurality of first contacts coupled to the insulative housing to form as a first unit module and having first contacting portions retained in the tongue portion; an insulator assembled to the insulative housing; a plurality of second contacts coupled to the insulator to form as a second unit and having second contacting portions extending upon the tongue portion; and a metal shell shielding the insulative housing and defining an interface with the tongue portion extending therein, typically, such as the connector disclosed in U.S. Pat. No. 7,618,293 issued on Nov. 17, 2009.

The base portion has a pair of protrusions formed at two lateral sides thereof for interferingly engaging with the metal shell so that the metal shell could be retained on the insulative housing reliably. However, when the metal shell is assembled to the insulative housing, the metal shell will scrape the protrusions, and in case of such scraping, the protrusions will be abraded easily and rending unwanted defects.

Hence, an improved connector with an improved housing is desired to overcome the above problems.

BRIEF SUMMARY OF THE INVENTION

According to one aspect of the present invention, a connector comprises: an insulative housing having a base portion and a tongue potion extending forwardly from the base portion, the base portion defining a retaining slot and a pair of side walls located at two lateral sides of the retaining slot, each side wall has at least a protrusion protruding outwardly from an outer face thereof; a plurality of contacts attached to the insulative housing; an insulator retained in the retaining slot and defining a pair of side surfaces facing inner faces of the side wall; at least one clearance being formed between the adjacent side surface and inner face and corresponding to the respective protrusion in a transverse direction; and a metal shell assembled to the insulative housing and covering the insulative housing and the insulator. The metal shell defines a top plate, a bottom plate opposite to the top plate, and a pair of side plates connecting the top and bottom plates and passing over the protrusions in a front-to-back direction perpendicular to the transverse direction when the metal shell is assembled to the insulative housing.

According to another aspect of the present invention, a connector comprises: a first unit module comprising an insulative housing and a plurality of first contacts coupled to the insulative housing; the insulative housing having a base portion and a tongue potion extending forwardly from the base portion, the base portion defining a pair of side walls spaced from each other along a transverse direction, the side walls have protrusions protruding outwardly from outer faces thereof; the first contacts having stiff first contacting portions retained in the tongue portion and first tail portions extending out of the base portion; a second unit module comprising an insulator and a plurality of second contacts coupled to the insulator; the insulator being sandwiched between the side walls in the transverse direction; the second contacts having resilient second contacting portions extending upon the tongue portion and located behind the first contacting portions and second tail portions extending out of the base portion; a metal shell assembled to the insulative housing and shrouding the first and second unit modules, the metal shell defining a pair of side plates shrouding the side walls and passing over the protrusions in a front-to-back direction perpendicular to the transverse direction when the metal shell being assembled to the insulative housing; and a pair of upheavals being located between the insulator and the side walls, and forming clearances located between the insulator and the side walls and aligned with the corresponding protrusions in the transverse direction so as to make the side walls deflectable at the clearances when side plates of the metal shell passing over the corresponding protrusions.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details.

Figure 1:
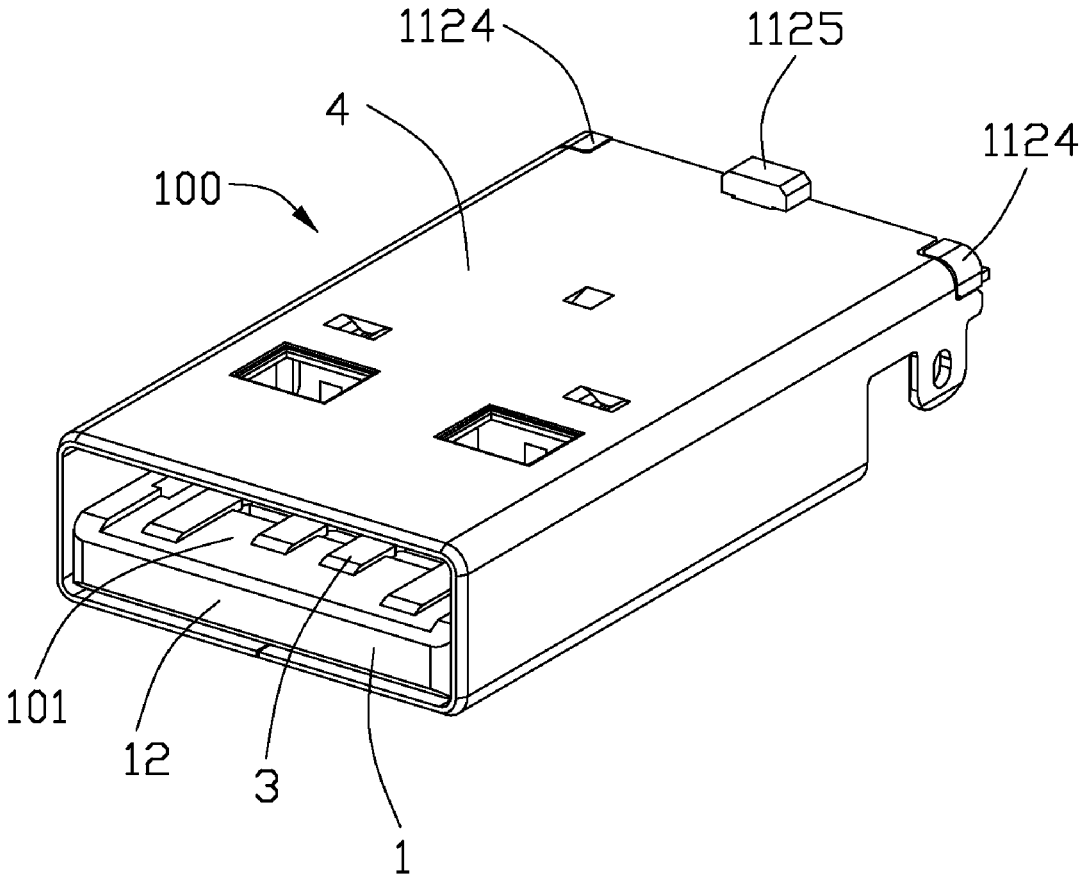
FIG. 1 is an assembled, perspective view of a connector according to an embodiment of the present invention.
Figure 2:
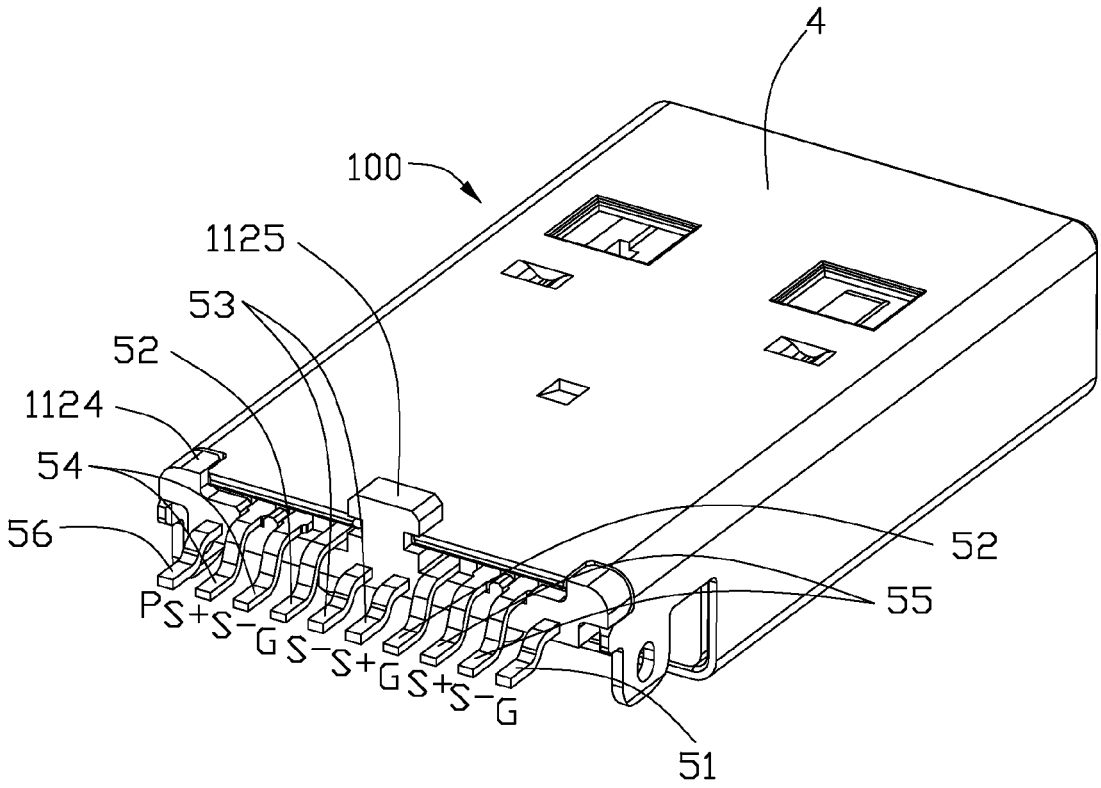
FIG. 2 is similar to FIG. 1, but viewed from another aspect.
Figure 3:
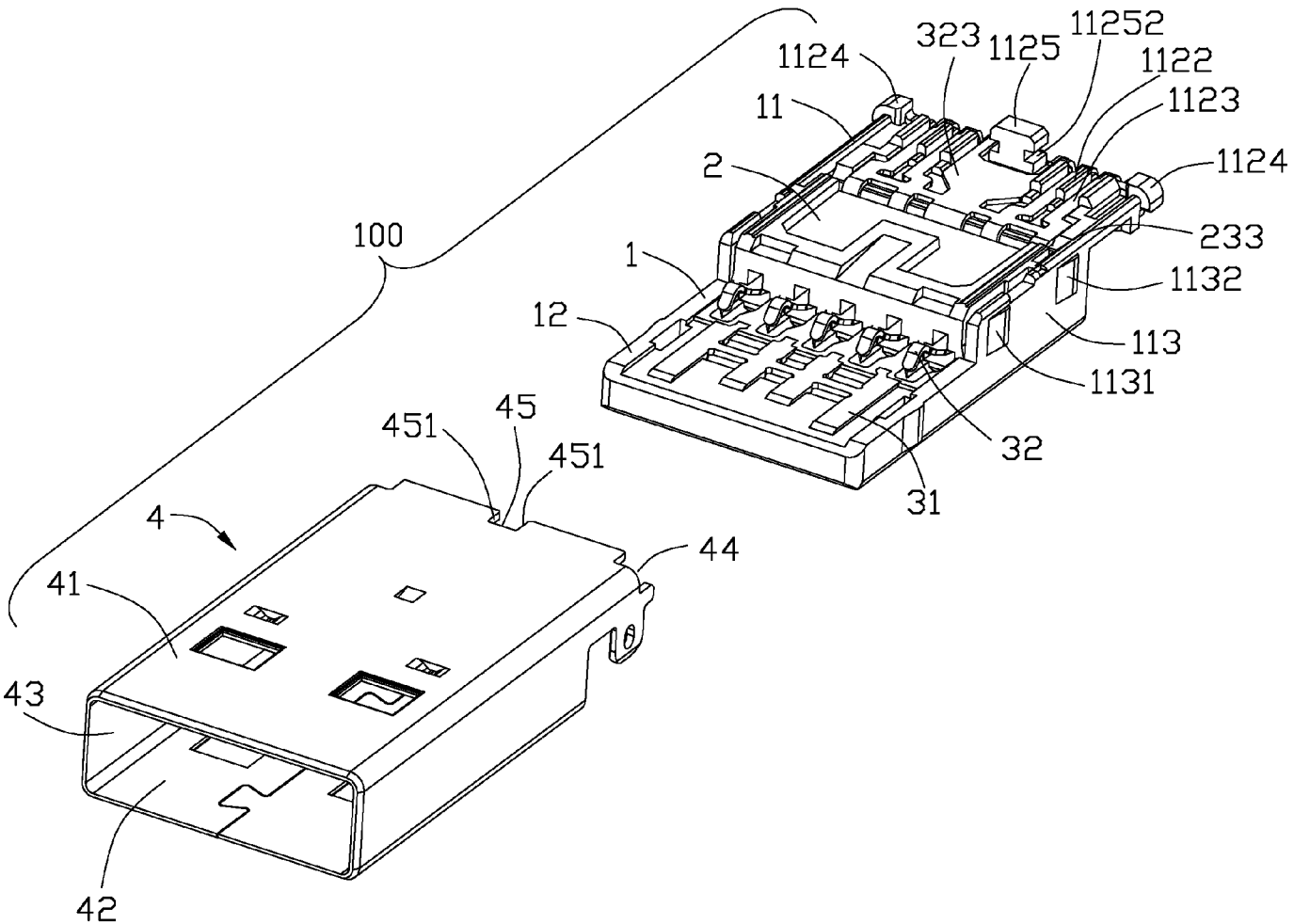
FIG. 3 is a partially exploded view of the connector shown in FIG. 1.
Figure 4:
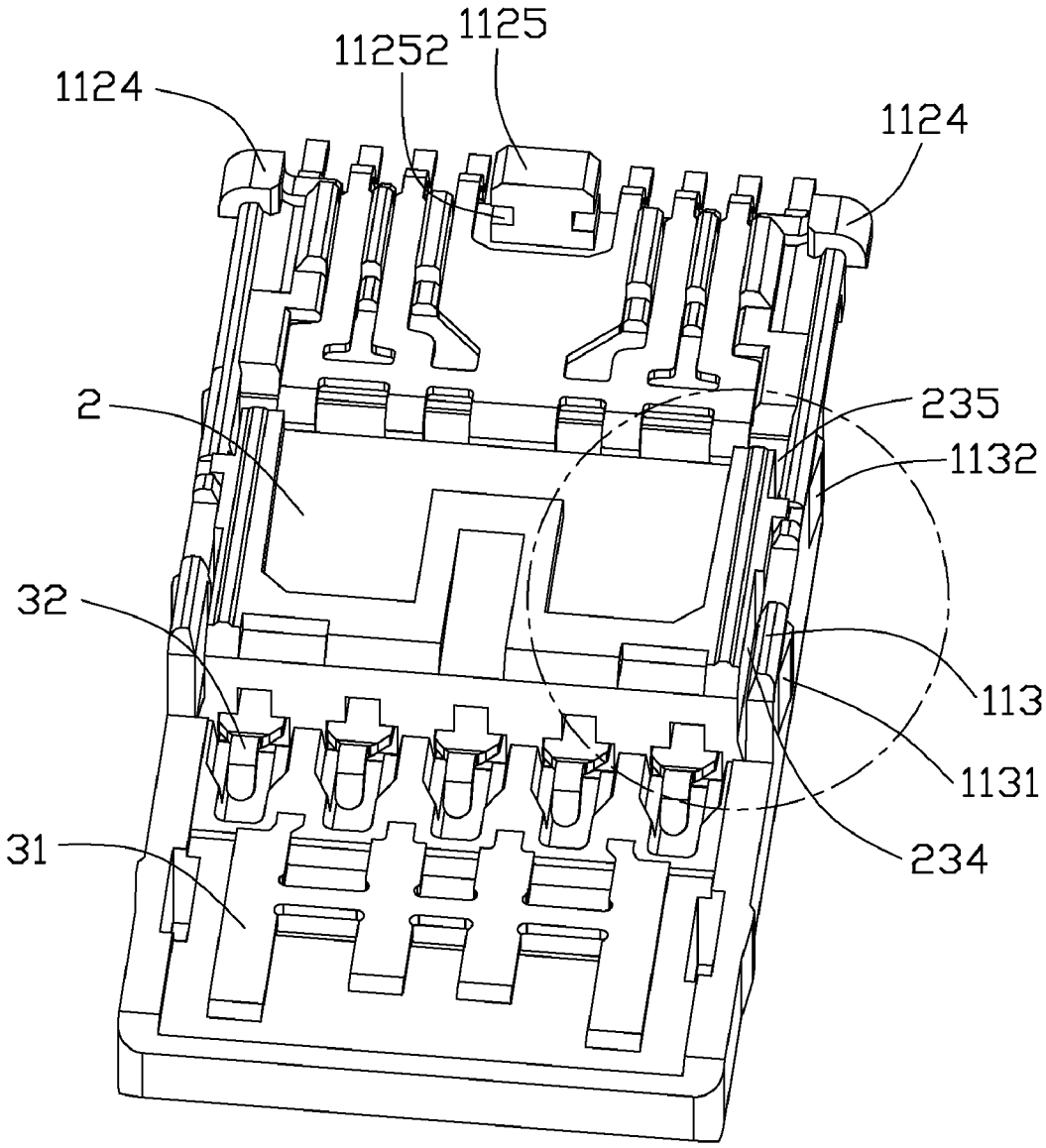
FIG. 4 is a perspective view of the connector with a metal shell removed therefrom.
Figure 5:
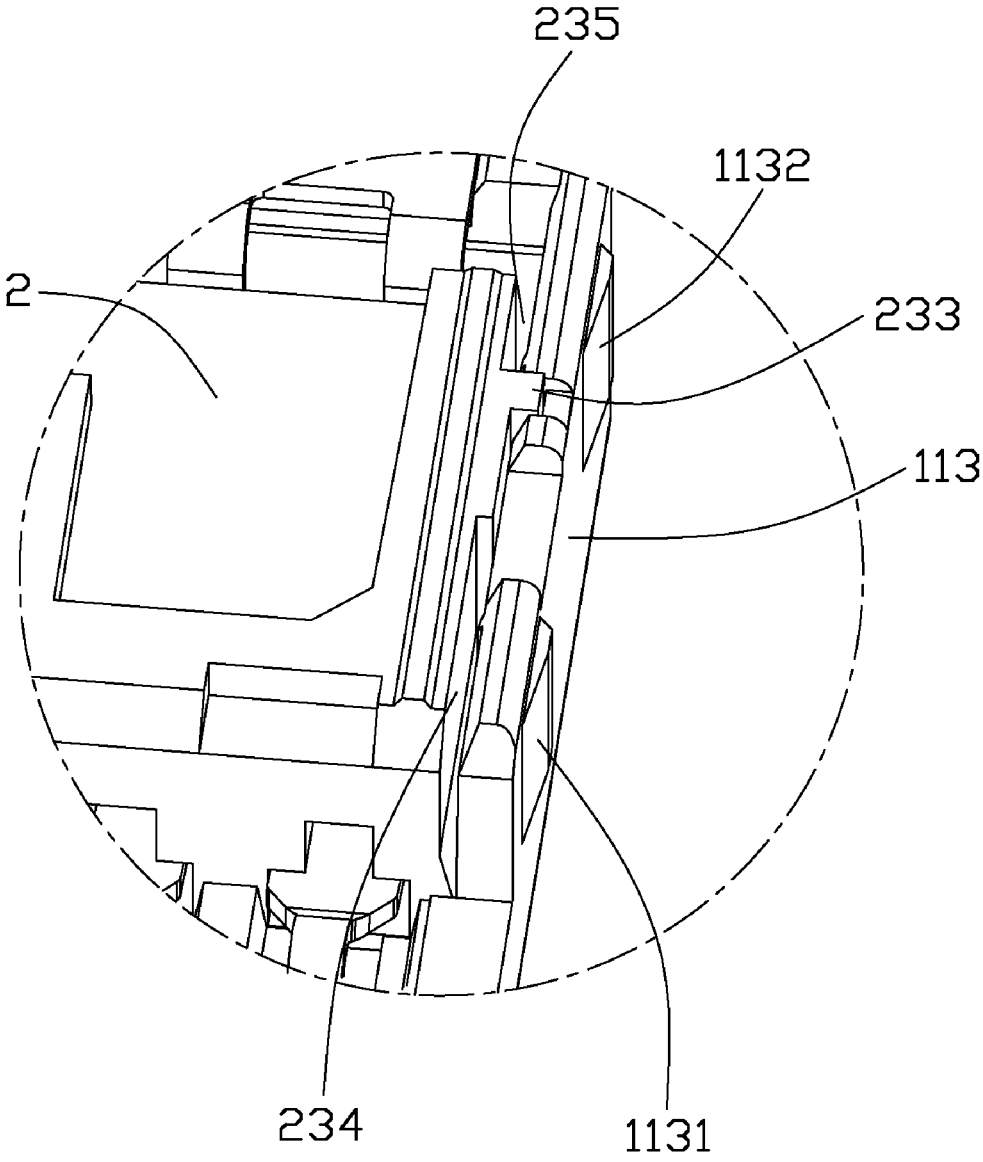
FIG. 5 is an enlarged view of a circle portion in FIG. 4.

Referring to FIGS. 1-3, a connector 100 according to an embodiment of the present invention is an A type USB 3.0 plug connector and defines an interface 101. The connector 100 comprises an insulative housing 1, a set of contacts 3 coupled to the insulative housing 1, an insulator 2 coupled to the insulative housing 1, and a metal shell 4 shielding the insulative housing 1 and the insulator 2.

Referring to FIGS. 3-7, The insulative housing 1 includes a base portion 11 and a tongue portion 12 extending forwardly from a front end of the base portion 11. The base portion 11 has a first portion 111 defining a retaining slot 1110 for receiving the insulator 2 and a pair of side walls 113 located at two lateral sides of the retaining slot 1110, and a second portion 112 extending backwardly from the first portion 111.

Figure 7:
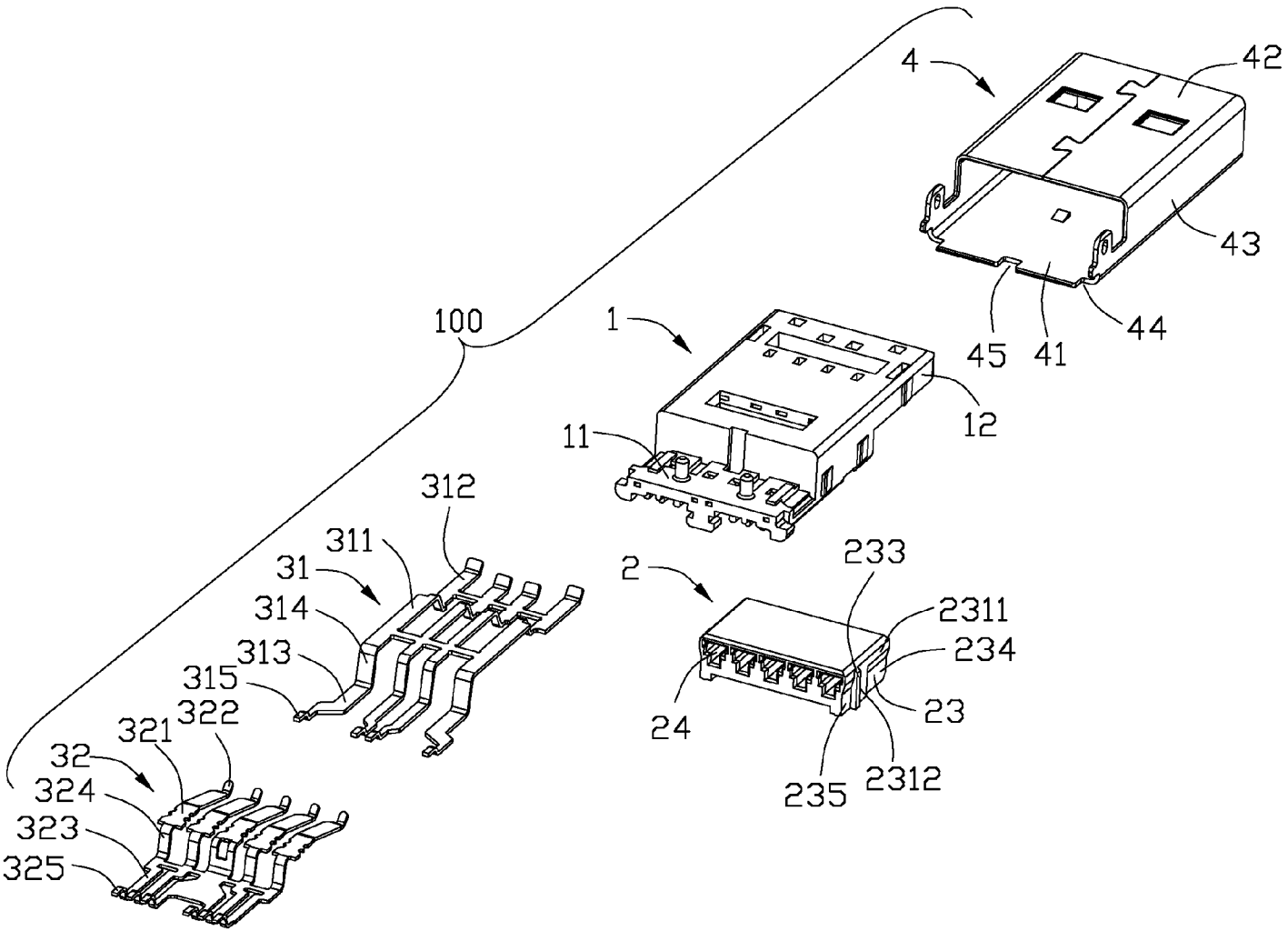
FIG. 7 is similar to FIG. 6, but viewed from another aspect.

The first portion 111 and the second portion 112 form as a ladder shape which can be presented explicitly in FIG. 7.

Referring to FIGS. 3-6, each side wall 113 has a first and second protrusions 1131, 1132 protruding outwardly from an outer face thereof, and a recess 1135 depressed from an inner face thereof and communicating with the retaining slot 1110. The recess 1135 locates between the first and second protrusions 1131, 1132 in a front-to-back direction. The first portion 111 has a first opening 1112 passing therethrough in a height direction of the insulative housing 1 and communicating with the retaining slot 1110, a vertical face 1120 facing the retaining slot 1110, and a pair of embossments 1113 protruding into the retaining slot 1110 and located between the first opening 1112 and the vertical face 1120. The second portion 112 has a horizontal upper face 1121 perpendicular to the vertical face 1120, a plurality of ribs 1122 protruding upwardly from the upper face 1121, and a plurality of cavities 1123 exposed to exterior and formed between each two adjacent ribs 1122.

The second portion 112 has a pair of first bumps 1124 protruding upwardly and outwardly therefrom, and a second bump 1125 protruding upwardly from the upper face 1121 and located between the first bumps 1124 in a transverse direction perpendicular to the front-to-back direction. The second bump 1125 is higher than the first bumps 1124 and has a pair of securing slots 11252 formed at two lateral sides thereof for retaining the metal shell 4.

Referring to FIGS. 4-7, the insulator 2 is received in the retaining slot 1110 and has a pair of upheavals 231 protruding outwardly from two side surfaces 23 thereof. Each upheaval 231 includes a horizontal portion 2311 extending along the front-to-back direction and resisting the inner face of the side wall 113, a vertical portion 2312 extending along the height direction and received in the corresponding recess 1135, and a flange 233 protruding outwardly from the horizontal and vertical portions 2311, 2312 and being locked into a slit 1130 formed in the recess 1135. Therefore, the insulator 2 could be retained in the insulative housing 1 reliably. The insulator 2 has a front depression 234 located at front of the vertical portion 2312 and above the horizontal portion 2211, and a rear depression 235 located at back of the vertical portion 2312 and above the horizontal portion 2211. When the insulator 2 is assembled to the retaining slot 1110, the front and rear depressions 234, 235 are corresponding to the first and second protrusions 1131, 1132 in the transverse direction, therefore, front and rear clearances are defined between the side surface 23 of the insulator 2 and the inner face of the side wall 113 corresponding to the first and second protrusions 1131, 1132 in the transverse direction. When the metal shell 4 is assembled to the insulative housing 1, the side wall 113 will have an elastic deformation at the front and rear clearances, therefore, the metal shell 4 could pass over the first and second protrusions 1131, 1132 smoothly so as to prevent the first and second protrusions 1131, 1132 from abrasion. In other embodiments, the front and rear depressions 234, 235 could be formed on the inner faces of the side walls 113. The tongue portion 12 has a number of projections 122 spaced from each other in the transverse direction and forms a number of passageways 123 between each two adjacent projections 122. The insulator 2 is retained between the embossments 1113 and the projections 122 in the front-to-back direction.

Figure 6:
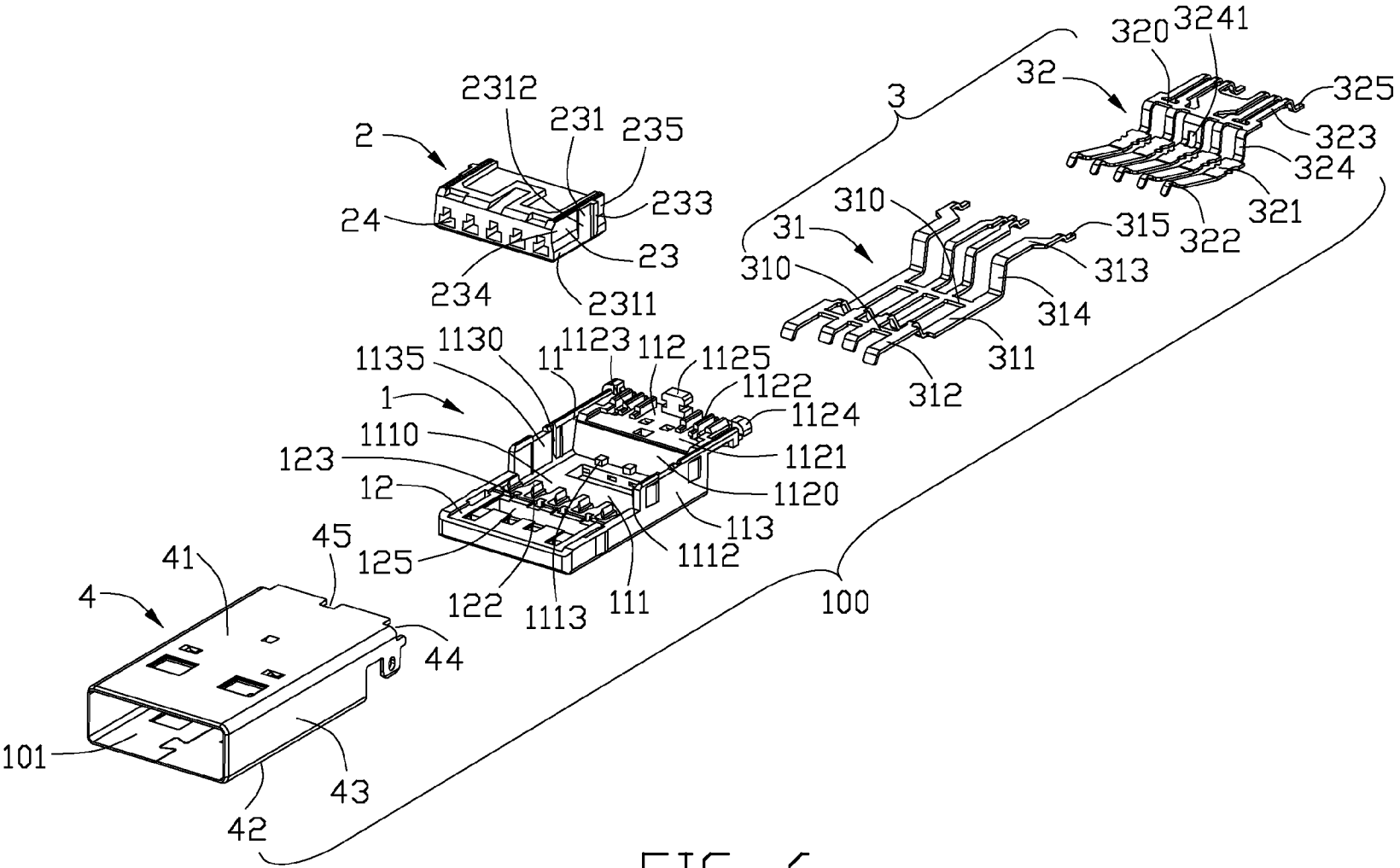
FIG. 6 is an exploded view of the connector shown in FIG. 1.

Referring to FIGS. 6-7, the contacts 3 are adapted for USB 3.0 protocol, and include a number of first contacts 31 and a number of second contacts 32. The first contacts 31 are adapted for USB 2.0 protocol and connected by two first contact carriers 310 before the first contacts 31 being made out. The first contacts 31 are insert molded into the insulative housing 1. The two first contact carriers 310 will be cut off from the first opening 1112 and a second opening 125 passing through the tongue portion 12 in the height direction so that the first contacts 31 could be separated from each other. The first contacts 31 include stiff first contacting portions 312 retained in the tongue portion 12 and exposed to the interface 101, first connecting portions 311 bending downwardly and extending backwardly from back ends of the first contacting portions 312, first bending portions 314 bending upwardly from back ends of the first connecting portions 311, first offset portions 313 extending backwardly from the first connecting portions 311 and offsetting horizontally, and first tail portions 315 connecting the first offsetting portions 313 and extending backwardly beyond the second portion 112. The two first contact carriers 310 connect the first contacts 31 at the first contacting portions 312 and the first connecting portions 311. The second contacts 32 are connected by a second contact carrier 320 before the second contacts 32 being made out and include resilient second contacting portions 322 received in the passageways 123 of the tongue portion 12, second connecting portions 321 extending backwardly from back ends the second contacting portions 322 and retained in retaining holes 24 passing through the insulator 2 in the front-to-back direction, second bending portions 324 bending upwardly from the second connecting portions 321 and extending through a space formed between the vertical face 1120 and the insulator 2, second offset portions 323 extending backwardly and offsetting horizontally, and second tail portions 325 connecting the second offset portions 323 and extending backwardly beyond the second portion 112. The second offset portions 323 are retained in the cavities 1123 of the second portion 112. The second contact carrier 320 connect the second contact 32 at the second offset portions 323 and is located upon the upper face 1121. In this embodiment, the second contacts 32 are assembled to the insulator 2 so as to form a module retained in the insulative housing 1, In other embodiments, the second contacts 32 could be insert molded into the insulator 2 to form a module retained in the insulative housing 1.

Conjoined with FIG. 7, the first contacts 31 include a first grounding contact 51, a power contact 56, and a first pair of differential contacts 53 located between the first grounding contact 51 and the power contact 56. The first offset portions 313 of the first grounding contact 51 and the power contact 56 offset oppositely along the transverse direction, therefore, a distance measured between the first tail portions 315 of the first grounding contact 51 and the power contact 56 is greater than a distance measured between the corresponding first contacting portions 312 or the corresponding first connecting portions 311. The first offset portions 313 of the first pair of differential contacts 53 offset toward each other in the transverse direction, therefore, a distance measured between the first tail portions 315 of the first pair of differential contacts 53 is smaller than a distance measured between the corresponding first contacting portions 312 or the corresponding first connecting portions 311.

The second contacts 22 include a second pair of differential contacts 54, a third pair of differential contacts 55, and a second grounding contact 52 located between the second and third pairs of differential contacts 54, 55. The second offset portions 323 of the second pair of differential contacts 54 offset toward each other in the transverse direction, therefore, a distance measured between the second tail portions 325 of the second pair of differential contacts 54 is smaller than a distance measured between the corresponding second contacting portions 322 or the corresponding second connecting portions 321. Similarly, the second offset portions 323 of the third pair of differential contacts 55 offset toward each other in the transverse direction, therefore, a distance measured between the second tail portions 325 of the second pair of differential contacts 54 is smaller than a distance measured between the corresponding second contacting portions 322 or the corresponding second connecting portions 321. The second bending portion 324 of the second grounding contact 52 has a width wider than those of the remaining second bending portions 324 and defines a through hole 3241 passing therethrough in the front-to-back direction. The second offset portion 323 of the second grounding contact 52 has a width wider than that of the second bending portion 324 and defines two split said second tail portions 325 spaced from each other in the transverse direction. The second bump 1125 is located between the two second tail portions 325 of the second grounding contact 52.

The first and second tail portions 315, 325 are arranged in one row, all of the second tail portions 325 are arranged between the first tail portions 315 of the first grounding contact 51 and the power contact 56. In another word, relative to the first and second tail portions 315, 325, the first grounding contact 51 and the power contact 56 are arranged at two outermost sides. The second tail portions 325 of the second pair of differential contacts 54 are arranged between the first tail portion 315 of the power contact 56 and one second tail portion 325 of the second grounding contact 52, the second tail portions 325 of the third pair of differential contacts 55 are arranged between the first tail portion 315 of the first grounding contact 51 and the other second tail portion of the second grounding contact 52. Referring to FIG. 3, all of the first and second tail portions 315,325 viewed from a back view and a left-to-right direction are arranged in the following specific sequence: power contact 56 (P) `the second pair of differential contacts 54 (S+, S−) `the second grounding contact 53 (G) `the first pair of differential contacts 52 (S−, S+) `the second grounding contacts 53 (G) `the third pair of differential contacts 55 (S+, S−) `the first grounding contact 51 (G). Therefore, in the first and second tail portions 315,325, each adjacent two pairs of the first, second and third pairs of differential contacts 53, 54, 55 has a grounding contact 52 located therebetween, the space between the first, second and third differential contacts 53, 54, 55 can be increased, the interference between the first, second and third differential contacts 53, 54, 55 can be reduced more effectively.

Referring to FIGS. 1-4, the metal shell 4 surrounds the tongue plate 12 to form the interface 101 and includes a top plate 41, a bottom plate 42 and a pair of side plates 43 connecting the top and bottom plates 41, 42. The metal shell 4 has a pair of first notches 44 formed between the top plate 12 and two side plates 43 and engaging with the corresponding first bumps 1124, a second notch 45 formed in a back side of the top plate 41 and engaging with the second bump 1125. The first bumps 1124 are received in the corresponding first notches 44 and resist the metal shell 4 forwardly, inwardly and downwardly. The second bump 1125 is received in the second notch 45. The top plate 41 has two securing portions 451 on two sides of the second notch 45 retained in the securing slots 11252 so that the top plate 41 could be orientated in the second bump 1125 in the height direction. Therefore, the second portion 112 has two sides resisted upwardly and outwardly by the metal shell 4 via the first bumps 1124 cooperating with the first notches 44, and a midst portion orientated along the height direction by the metal shell 4 via the second bump 1125 cooperating with the second notch 45, the second portion 112 could be presented from warp along the height direction, and the first and second tail portions 315, 325 will be preferably coplanar in a horizontal plane for being soldered to a printed circuit board reliably. In another embodiment, the second bump 1125 could have only one said securing slot 11252 formed thereon, the top plate 41 has one said securing portion 451 extending backwardly from a rear end thereof and being retained in said securing slot 11252. When the metal shell 4 is assembled to the insulative housing 1 along the front-to-back direction, the side wall 113 will have an elastic deformation at the front and rear depressions 234, 235, therefore, the side plates 43 of the metal shell 4 could pass over the first and second protrusions 1131, 1132 smoothly, and the first and second protrusions 1131, 1132 could be prevented from abrasion.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A connector comprising:

an insulative housing having a base portion and a tongue potion extending forwardly from the base portion, the base portion defining a retaining slot and a pair of side walls located at two lateral sides of the retaining slot, each side wall has at least one protrusion protruding outwardly from an outer face thereof;

a plurality of contacts attached to the insulative housing;

an insulator retained in the retaining slot and defining a pair of side surfaces facing inner faces of the side wall;

at least one clearance being formed between the adjacent side surface and inner face and corresponding to the respective protrusion in a transverse direction; and a metal shell assembled to the insulative housing and covering the insulative housing and the insulator, the metal shell defining a top plate, a bottom plate opposite to the top plate, and a pair of side plates connecting the top and bottom plates for covering the outer face and passing over the protrusions in a front-to-back direction perpendicular to the transverse direction when the metal shell being assembled to the insulative housing.

2. The connector according to claim 1, wherein the insulator has a pair of upheavals protruding outwardly from said two side surfaces, and defines at least one depression at said each of the two side surfaces to form said corresponding clearances.

3. The connector according to claim 2, wherein each upheaval includes a horizontal portion extending along the front-to-back direction and resisting the inner face, and a vertical portion extending along a height direction, the depression is located at a front or back of the vertical portion and above the horizontal portion.

4. The connector according to claim 3, wherein the side wall has a recess depressed from the inner face and communicating with the retaining slot to receive the vertical portion.

5. The connector according to claim 4, wherein the insulator has a flange protruding outwardly from the horizontal and vertical portions and being locked into a slit formed in the recess.

6. The connector according to claim 4, wherein each side wall has a pair of said protrusions protruding outwardly from the outer face, the recess is located between the protrusions along the front-to-back direction, the insulator has a pair of said depressions formed at each side surface and corresponding to said protrusions in the transverse direction to form two said corresponding clearances.

7. The connector according to claim 1, wherein the contacts include a plurality of first contacts having stiff first contacting portions retained in the tongue portion and first tail portions extending out of the insulative housing; a plurality of second contacts retained in the insulator to form a module and having resilient second contacting portions extending upon the tongue portion and located behind the first contacting portions and second tail portions extending out of the insulative housing.

8. The connector according to claim 7, wherein the base portion includes a first portion connecting the tongue portion and defining said retaining slot and side walls, and a second portion extending backwardly from the first portion under a condition that the first and second portions present as a ladder shape viewed from a back aspect.

9. The connector according to claim 8, wherein the tongue portion has a number of projections spaced from each other in the transverse direction and forms a plurality of passageways between each two adjacent projections for receiving the second contacting portions, the first portion has at least one embossment protruding into the retaining slot, the insulator is retained between the projection and the embossment along the front-to-back direction.

10. The connector according to claim 9, wherein the first portion has a vertical face forwardly facing the retaining slot, the second contacts have second bending portions located between the second contacting and the second tail portions and vertically extending through a space formed between the vertical face and the insulator.

11. The connector according to claim 8, wherein the first contacts are insert molded into the insulative housing, the first and second tail portions extend backwardly beyond the second portion and are arranged in one row.

12. A connector comprising:

a first unit module comprising an insulative housing and a plurality of first contacts coupled to the insulative housing; the insulative housing having a base portion and a tongue potion extending forwardly from the base portion, the base portion defining a pair of side walls spaced from each other along a transverse direction, the side walls having protrusions protruding outwardly from outer faces thereof; the first contacts having stiff first contacting portions retained in the tongue portion and first tail portions extending out of the base portion;

a second unit module comprising an insulator and a plurality of second contacts coupled to the insulator; the insulator being sandwiched between the side walls in the transverse direction; the second contacts having resilient second contacting portions extending upon the tongue portion and located behind the first contacting portions and second tail portions extending out of the base portion;

a metal shell assembled to the insulative housing and shielding the first and second unit modules, the metal shell defining a pair of side plates shielding the side walls and passing over the protrusions in a front-to-back direction perpendicular to the transverse direction when the metal shell being assembled to the insulative housing; and a pair of upheavals being located between the insulator and the side walls, and forming clearances located between the insulator and the side walls and aligned with the corresponding protrusions in the transverse direction so as to make the side walls deflectable at the clearances when the side plates of the metal shell passing over the corresponding protrusions.

13. The connector according to claim 12, wherein the upheavals protrude outwardly from two side surfaces of the insulator, and a pair of depressions are formed at said two side surfaces so as to form said corresponding clearances.

14. The connector according to claim 13, wherein each upheaval includes a horizontal portion extending along the front-to-back direction and resisting an inner face of the side wall, and a vertical portion extending along a height direction, the depression is located at a front or back of the vertical portion and above the horizontal portion.

15. The connector according to claim 14, wherein the side wall has a recess depressed from the inner face and communicating with the retaining slot to receive the vertical portion.

16. The connector according to claim 15, wherein the insulator has a flange protruding outwardly from the horizontal and vertical portions and being locked into a slit formed in the recess.

17. An electrical connector comprising:

an insulative housing defining a mating tongue, and a pair of side walls extending along a front-to-back direction and spaced from each other in a transverse direction perpendicular to said front-to-back direction;

at least a pair of protrusions respectively protruding outwardly on corresponding exterior faces of said pair of side walls in the transverse direction;

an insulator receiving cavity formed between the pair of side walls and located behind the mating tongue in said front-to-back direction;

a plurality of first contacts disposed in the housing with first contacting sections exposed upon a mating face of the mating tongue in a vertical direction perpendicular to both said front-to-back direction and said transverse direction;

an insulator snugly dispose in the insulator receiving cavity and regulating a plurality of second contacts therewith, said second contacts defining a plurality of second contacting sections exposed upon the mating face in the vertical direction; and a pair of clearances are formed between the insulator and the corresponding side walls, respectively; wherein each clearance is essentially aligned with the corresponding protrusion in the transverse direction so as to allow the corresponding side wall to be somewhat deflected into said clearance when a metallic shell encloses the housing to inwardly press the protrusion in the transverse direction.

18. The electrical connector as claimed in claim 17, wherein the first contacts are configured not to be deflectable while the second contact are configured to be deflectable.

19. The electrical connector as claimed in claim 17, wherein the mating tongue is confined between the pair of side walls, and another pair of protrusions outwardly protruding on the corresponding exterior faces, respectively, and a pair of depressions formed in corresponding side regions of the mating tongue and aligned with the corresponding another pair of protrusions in the transverse direction for allowing inward deformation around said another pair of protrusions when the metallic shell encloses the housing.

20. The electrical connector as claimed in claim 17, wherein the first contacts are embedded within the housing via an insert molding process while the second contacts are assembled into corresponding passageways defined in the insulator.

* * * * *